US007935282B2

(12) United States Patent
Feng et al.

(10) Patent No.: US 7,935,282 B2
(45) Date of Patent: May 3, 2011

(54) METHOD FOR PRODUCING MICROFINE FIBER AND FRIENDLY ARTIFICIAL LEATHER MADE THEREFROM

(75) Inventors: Chung-Chih Feng, Kaohsiung Hsien (TW); Chih-Yi Lin, Kaohsiung Hsien (TW); Gao-Long Yang, Kaohsiung Hsien (TW); Szu-Wei Huang, Kaohsiung Hsien (TW); Ming-Hsiung Liang, Kaohsiung Hsien (TW); Jong-Shy Lin, Kaohsiung Hsien (TW); Yuan-Chih Lan, Kaohsiung Hsien (TW)

(73) Assignee: San Fang Chemical Industry Co., Ltd., Jen-Wu Hsiang, Kaohsiung Hsien (TW)

( * ) Notice: Subject to any disclaimer, the term of this patent is extended or adjusted under 35 U.S.C. 154(b) by 126 days.

(21) Appl. No.: 12/192,455

(22) Filed: Aug. 15, 2008

(65) Prior Publication Data

US 2009/0051081 A1 Feb. 26, 2009

(30) Foreign Application Priority Data

Aug. 20, 2007 (TW) ..... 96130783 A

(51) Int. Cl.
*D01D 5/26* (2006.01)
*D01D 5/32* (2006.01)

(52) U.S. Cl. ..... 264/103; 264/172.17; 264/172.18; 156/296; 442/60; 428/361

(58) Field of Classification Search ..... 264/103, 264/172.17, 172.18; 156/296; 442/59, 60; 428/361

See application file for complete search history.

(56) References Cited

U.S. PATENT DOCUMENTS

| | | | | |
|---|---|---|---|---|
| 3,966,865 | A * | 6/1976 | Nishida et al. | 264/147 |
| 6,335,092 | B1 * | 1/2002 | Takeda et al. | 428/359 |
| 6,737,004 | B2 * | 5/2004 | Wang et al. | 264/103 |
| 6,780,469 | B2 * | 8/2004 | Iijima et al. | 427/336 |
| 6,838,043 | B1 * | 1/2005 | Wagner et al. | 264/555 |
| 2005/0215157 | A1 * | 9/2005 | Dugan et al. | 442/411 |

* cited by examiner

*Primary Examiner* — Kat Wyrozebski
*Assistant Examiner* — Scott W Dodds
(74) *Attorney, Agent, or Firm* — patenttm.us

(57) ABSTRACT

A method for producing microfine fibers having low resistance to deformation and high elasticity in accordance with the present invention comprises acts of: (a) providing polymer A and polymer B; (b) melting polymer A and polymer B to make a filament; (c) drawing the filament to make a staple fiber; (d) entangling the staple fiber to form a non-woven; (e) impregnating the non-woven with a impregnating agent; and may further have the acts of (f) impregnating the nonwoven with polyurethane; (g) coagulating the non-woven with dimethylformamide (DMF); (h) washing the non-woven with hot water; (i) impregnating the non-woven with a treatment agent; (j) abrading the non-woven to attain a split type mirofine fiber substrate; and (k) bonding a coating to the microfine fiber substrate. Therefore, the method can attain an artificial leather product having low resistance to deformation and high elasticity.

8 Claims, 5 Drawing Sheets

METHOD FOR PRODUCING MICROFINE FIBER AND FRIENDLY ARTIFICIAL LEATHER MADE THEREFROM

BACKGROUND OF THE INVENTION

1. Field of the Invention

The present invention relates to a method for producing environmentally friendly microfine fiber and artificial leather products having low resistance to deformation and high tensity.

2. Description of the Prior Arts

A conventional method of producing microfine fiber artificial leather comprises reacting a solvent with a basic solution and a product of seperation.

TW76102732 discloses a method for producing microfine fibers. The fibers are made on a polyester membrane. Therefore, when a membrane fibrillation process is conducted, the membrane has to be detached from the fibers by dissolving the polyester membrane with basic solvent. Then the fiber is mechanically cleaved. Accordingly, this conventional method may result in serious water pollution.

Either U.S. Pat. No. 6,517,938 or JP2003105679 discloses a method for producing leather from microfine fibers. First, microfine fibers bundled to form a non-woven fabric, this is shrunk and impregnated with elastic polymer and a release agent is added before drying. Then, the microfine fibers are treated to attain artificial leather. However, the method uses a lot of solvent and produces much waste so the method has high cost and may cause environmental pollution.

JP2003105679 discloses a slice of artificial leather. The artificial leather is from filaments. First, the filaments are made into multiple webs having suitable weight and thickness. Then, the webs are layered into a three-dimensional non-woven material and mechanically bonded using needle punching or the like. Then, the non-woven material is impregnated with elastic polymer and pressed in a mold to attain the slice of artificial leather. However, the slice artificial leather lacks entirety and has low elasticity and a tensile strength less than 300 N/5 cm.

U.S. Pat. No. 6,838,043 discloses a method of producing a synthetic leather comprising depositing ultra-fine filaments to form a non-woven material that is bonded using high pressure water, impregnated with polyurethane (PU) and undergoing an after-treatment to get the synthetic leather. However, the method requires a lot of solvent and produces much waste so the has a high cost and may cause environmental pollution.

JP2001192936 discloses a method of producing an ultra-fine fiber, non-woven, splitable material using melt-spinning. However, a leather made of the non-woven lacks entirety the material does not have good elasticity and the tensile strength is around 300 N/5 cm.

To overcome the shortcomings, the present invention provides a method of producing environment friendly microfine fibers and leather made therefrom having low resistance to deformation and high elasticity to mitigate or obviate the aforementioned problems.

SUMMARY OF THE INVENTION

The aim of the invention is to provide a method for producing microfine fibers and artificial leather having low resistance to deformation and high tensity.

The method in accordance with the present invention comprises acts of: (a) providing polymer A and polymer B; (b) melting polymer A and polymer B to make a filament by conjugate spinning method; (c) drawing the filament to make a staple fiber; (d) entangling the staple fiber to form a non-woven; (e) impregnating the non-woven with an impregnating agent (f) impregnating the nonwoven with polyurethane; and may further comprise the acts of:

(g) coagulating the non-woven with dimethylformamide (DMF); (h) washing the non-woven with water; (i) impregnating the non-woven with a treatment agent; (j) abrading the non-woven to attain a splittable type mirofine fiber substrate; and (k) bonding a coating to the microfine fiber substrate.

Therefore, the method can attain an artificial leather with low resistance to deformation and high tensity.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
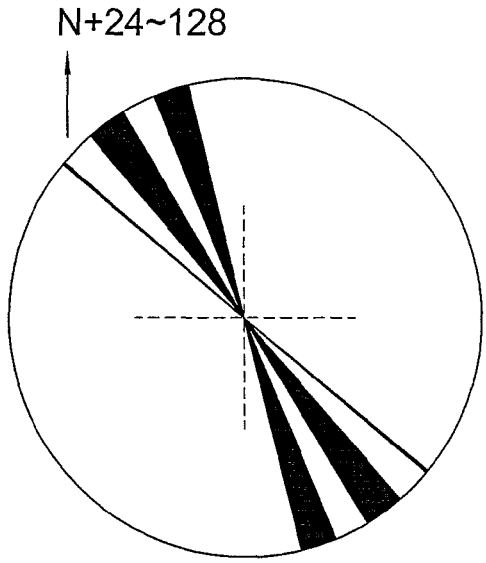
FIG. 1 illustrates an arrangement of microfine fibers in accordance with the present invention of polymers A and B.

A method for producing microfine fibers having low resistance to deformation and high tensity in accordance with the present invention comprises acts of: (a) providing polymer A and polymer B; (b) melting polymer A and polymer B to make a filament by conjugate spinning method; (c) drawing the filament to make a staple fiber; (d) entangling the staple fiber to form a non-woven; (e) impregnating the nonwoven with an impregnating agent; (f) impregnating the nonwoven with polyurethane and may further comprise acts of (g) coagulating the non-woven with dimethylformamide (DMF); (h) washing the non-woven with water; (i) impregnating the non-woven with a treatment agent; (j) abrading the non-woven to attain a splittable type mirofine fiber substrate; and (k) bonding a coating to the microfine fiber substrate.

The act of (a) providing Polymer A is selected from the group consisting of Polybutylene terephthalate (PBT). A melting temperature of polymer A is from 200 to 300° C. Polymer B is selected from the group, has a low initial modulus, consisting of polyamides and caprolactam, lauryl lactam, 4,4'-dimethyl-diisocyanate and toluene diisocyanate, a dicarboxylic acid and a polyamine. The dicarboxylic acid is selected from the group consisting hexanedioic acid, azelaic acid, terephthalic acid, isophthalic acid, cyclo-hexane-1,4-carboxylic acid. The polyamine is selected from the group consisting 1,6-hexanediamine, trimethyl-1,6 hexanediamine, 4,4'-methylenedicyclohexylamine (PACM), 4,4'-diaminodicyclohexylpropane, isophorone diamine, caprolactam, lauryl lactam, 4,4'-dimethyl-diisocyanate, toluene diisocyanate and polymer B is selected from the group consisting of Nylon 6 and Nylon 66. A melting temperature of polymer B is from 180 to 290° C.

The act of (b) melting polymers A and B to make a filament comprises providing a conjugate spinning machine having a spinning beam. The spinneret are respectively filled with polymers A and B. The spinning beam is heated between 200° C. and 290° C. The conjugate spinning machine is preset to melt polymer A and polymer B in a ratio between 1 to 9 and 9 to 1 and filaments are extruded to get undrawing composite filaments with 5 to 20 denier per filament (dpf) and a winder being 300~2000 m/min. Preferably, the filaments are drawn to get fully drawing composite filaments with 2 and 10 dpf or an air-flow draft rate being 3500~7000 m/min with 2 and 10 dpf by spunbond spinning.

Figure 2A:
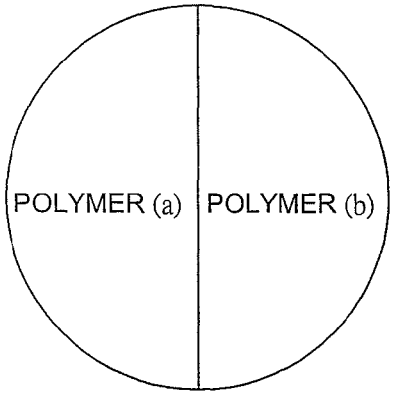
FIGS. 2A to 2C illustrate microfine fibers comprising arrangements of polymers in prior art.
Figure 2B:
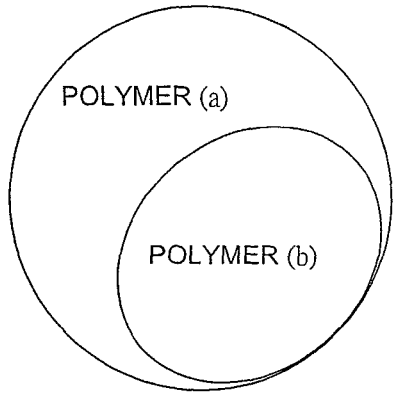
Figure 2C:
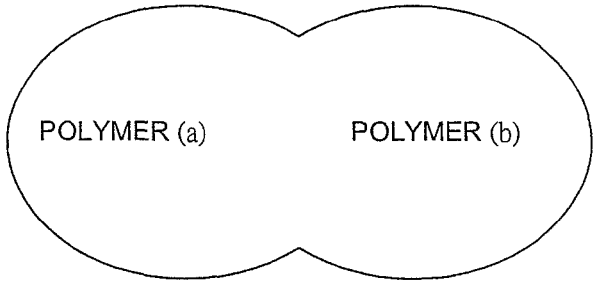
Figure 3:
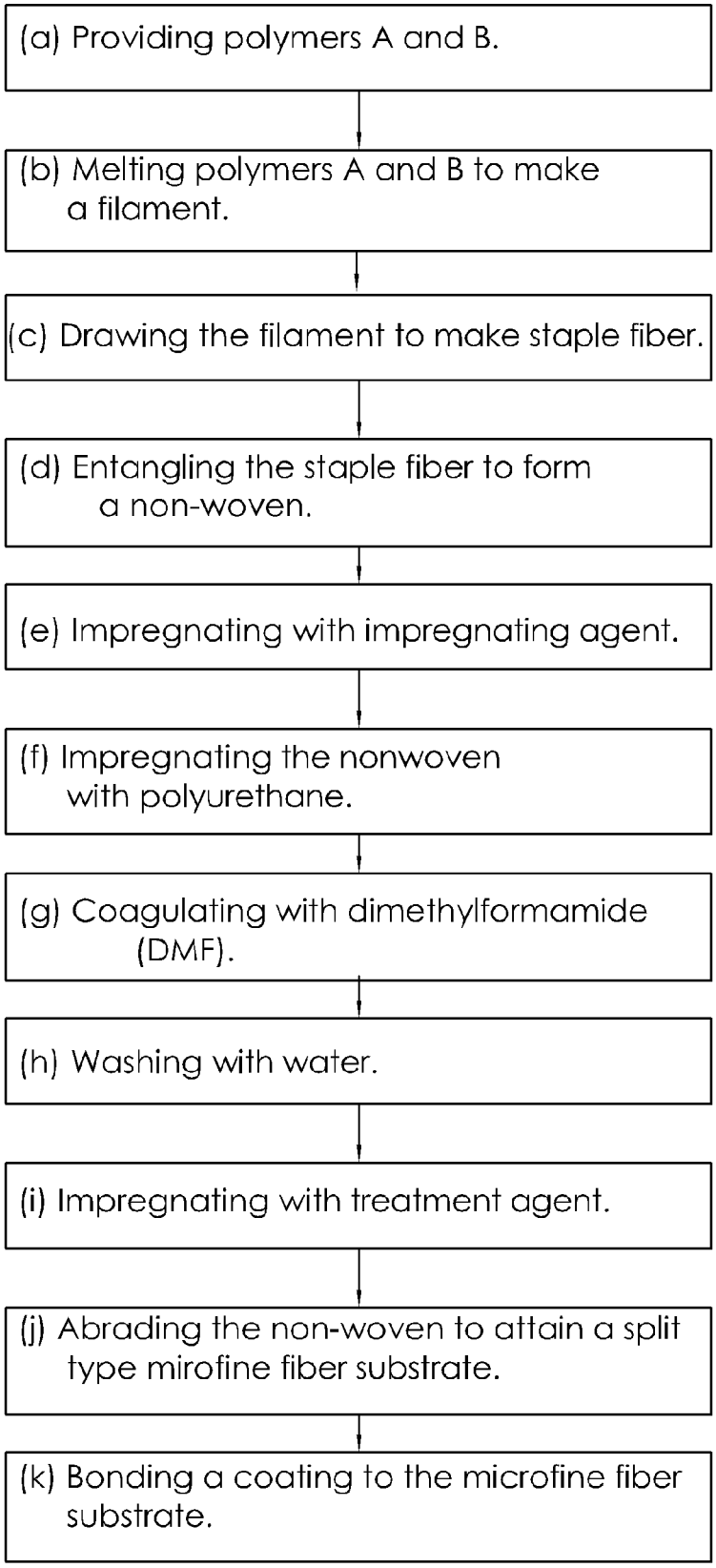
FIG. 3 is a flow diagram showing a manufacture process for producing microfine fiber in accordance with the present invention.

With reference to FIGS. 1 and 2, polymer A and polymer B may be extruded into an alternate arrangement having 24 to 128 number alternating units of polymer A and polymer B. Alternatively, polymers A and B may be spun to form a conjugate spinneret. The way of the filament and microfine fiber to get from the composite spinning is public in the prior art. The filament getting from composite spinning makes the splittable type microfine fiber with compressing way. A number of segments of the splittable type microfine fiber is between 24 and 128.

The act of (c) drawing the filament to make a staple fiber comprises drawing the filament and cutting filament to attain the staple fiber.

In the act of (d) entangling the staple fiber to form a non-woven, the non-woven is formed with a basis weight of 100 to 700 g/m$^2$. The act of (d) needle punching or water punching or spunbond processing, the spunbond spinning may comprise laminating the fully drawing composite filaments until the basis weight is between 100 to 700 g/m$^2$ and then using needle punching machine or water punching machine to form the non-woven.

In the act of (e) impregnating the nonwoven with an impregnating agent, preferably, the impregnating agent is selected from the group consisting of silicon, polyurethane and polyvinyl alcohol. Preferably, the concentration of the treatment reagent is between 0.1 and 15%. More preferably, the concentration of the treatment reagent is 3 to 10%.

In the act of (f) impregnating the nonwoven with polyurethane, preferably, the polyurethane is selected from the group consisting of water-base polyurethane and oil-polyurethane. Preferably, a solid content of solvent-base polyurethane is 10 to 25%. More preferably, a solid content of solvent-base polyurethane is 14 to 20%. Preferably, the solid content of water-base polyurethane is 15 to 30%. More preferably, the solid content of solvent-base polyurethane is 18 to 26%.

The act of (h) washing the non-woven with water comprises washing the non-woven with hot water. Preferably, hot water is from 50 to 90° C.

In the act of (i) impregnating the non-woven with a treatment agent, the treatment agent is organic treatment agent containing silicon a solid content of organic treatment agent is 0.1 to 15%. More preferably, a solid content of organic treatment agent is 3 to 7%.

The act of (j) abrading the leather comprises the leather being abraded by a machine to attain a substrate with low resistance to deformation and high tensity.

In the act of (k) bonding a coating to the substrate, the coating may be bonded using a paste to make an artificial leather product having low resistance to deformation and high tensity.

Therefore, the method for manufacturing the microtine fiber of the invention has the following advantages:

1. Requiring little solvent.
2. No waste water.
3. Low cost.
4. Protecting environment.
5. Improved elasticity.
6. Without using a reduction process for removing solvent.

Furthermore, the leather produced has good feeling.

So that the invention is more clearly understood, the following terms are defined:

The term "initial modulus," as used herein, that is used to a measure of the material flexible ability. The initial modulus is expressed as grams of load per unit stretch for a certain fiber denier.

The following examples further illustrate the present invention but are not to be construed as limiting the invention as defined in the claims appended hereto.

(1) Equipment
Mettler Toledo DL32 (Karl Fischer Coulomater)
TEXTECHNO VIBROMAT ME
TEXTCHNO FAFEGRAPH HR
(2) Measuring Method
Water content ASTM D 6869-03
Fiber fineness ASTM D 1577
Fabric Strength BISFA 1985/1989 Charpter F Example 1

PBT chip left to dry at 130° C. for 4 hours until the PBT contained less than 100 ppm of water. Nylon 6 (polymer B) chip left to dry at 90° C. for 4 hours until the nylon contained less than 300 ppm of water. Then, polymer A and polymer B were charged into the conjugate spinning machine having two extruders and a spinning beam. The temperature of the extruder polymer A was set at 255° C., 270° C. and 270° C. respectively for the first district to the third district. The temperature of the extruder polymer B was set for 260° C., 290° C. and 290° C. respectively for the first district to the third district. The temperature of the spinning beam was set to 270° C. The conjugate spinning machine is preset to respectively melt polymer A and polymer B in a weight ratio of 54% and 46% to make a filament. The filament has fineness being 7.0 den, strength being 2.5 g/den and elongation being 260%. A draw ratio of the filament is 2.0 times in 85° C. hot water and the filament was cut to attain 51 mm staple fibers. The staple fiber has fineness being 4.0 den, strength being 4.8 g/den strength and elongation being 45%. The staple fiber is splittable type mirofine fiber of the present invention.

The staple fiber was then made into a non-woven having a basis weight being 375 g/cm$^2$ and 1.52 mm thickness by forming a web by needle punching.

The non-woven was impregnated with 10% polyvinyl alcohol (PVA) and then dried. Then, the non-woven was impregnated with 15% solid content polyurethane. The non-woven was coagulated with 30% dimethyl formamide (DMF) and washed by 60° C. hot water and then dried. The leather was further polished and kneaded, and was impregnated with an organic treatment agent containing silicon.

Figure 4:
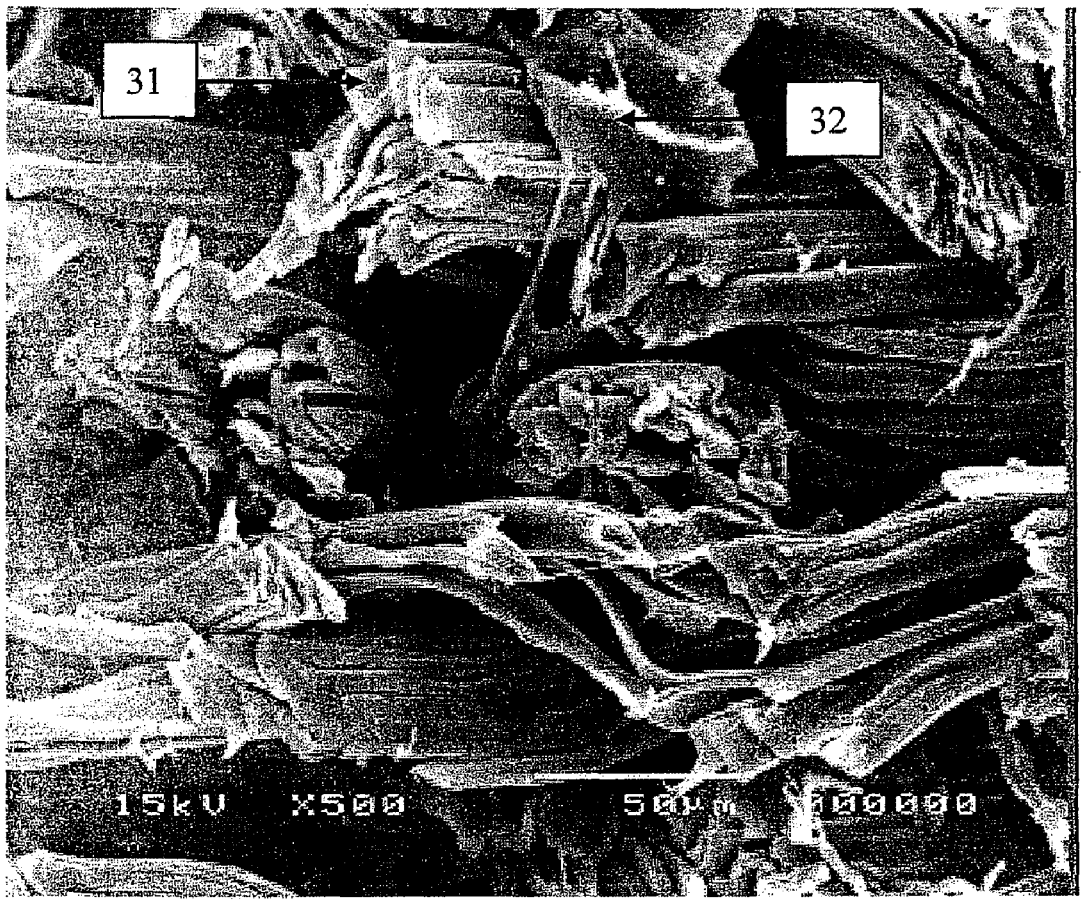
FIG. 4 is an electron microscopy image of a non-woven of the first embodiment in accordance with the present invention.
Figure 5:
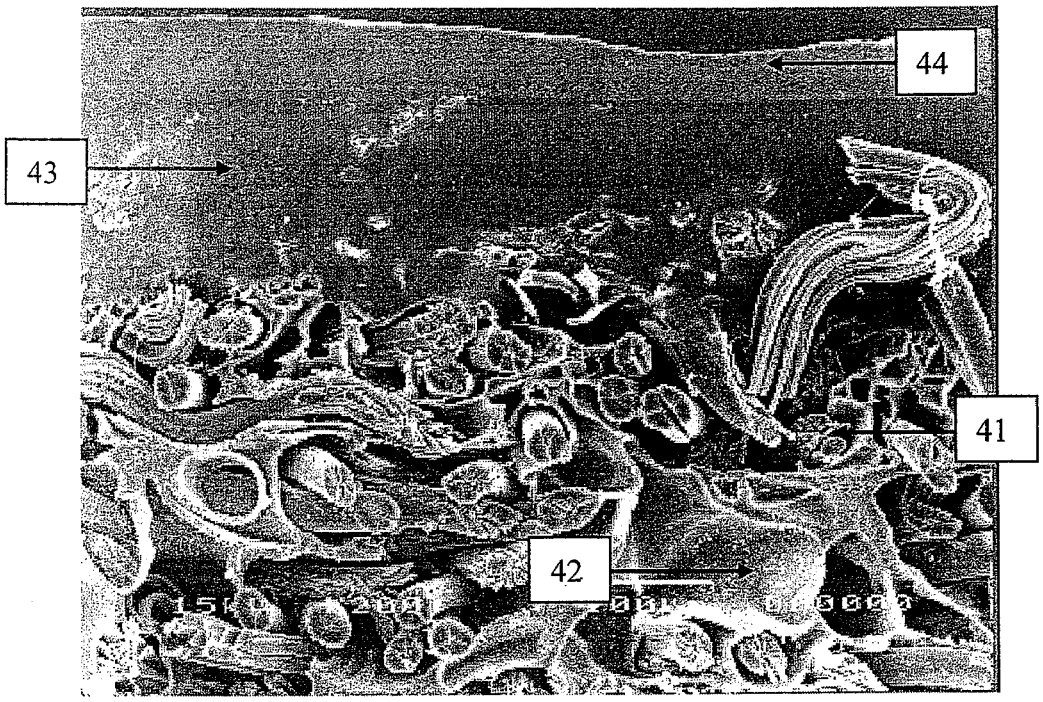
FIG. 5 is an electron microscopy image of artificial leather of the first embodiment in accordance with the present invention.

With reference to FIGS. 4 and 5, the leather is abraded by a machine to attain a substrate comprising the filament (31, 41) and polyurethane (32, 42). The substrate further had a coating (44) bonded thereon with a paste (43) to make an artificial leather product having low resistance to deformation and high tensity. The artificial leather weighed 640 g/m$^2$, was 1.33 mm thick and had a tensile strength of 35 kg/2.54 cm and peeling strength of 4.5 kg/cm.

Example 2

PBT chip dried at 130° C. for 4 hours until PBT contained less than 100 ppm of water. Nylon 6 (polymer B) was cut into slices and dried at 90° C. for 4 hours until the nylon contained less than 300 ppm of water. Then, polymer A and polymer B were charged into the conjugated spinning machine having two extruders and a spinning beam. The temperature of the extruder of polymer A was set to 255° C., 268° C. and 268° C. respectively for the first district to the third district. The temperature of the other extruder of polymer B was set to 260° C., 295° C. and 295° C. respectively for the first district to the third district. The temperature of the spinning beam was 270° C. The conjugate spinning machine was preset to melt polymer A and polymer B to a weight ratio of 32% and 68% respectively. The filament has fineness being 6.0 den, strength being 2.7 g/den and elongation being 300%. A draw ratio of the filament was 2.44 times in 75° C. hot water and the filaments were cut into to 60 mm staple fibers. The staple fiber has fineness being 3.0 den, strength being 5.9 g/den and elongation being 35%. The staple fiber is splittable type mirofine fiber of the present invention.

The staple fiber was then made into a non-woven having 378 g/cm$^2$ and 1.51 mm thickness by entangling and needle punching. The non-woven was impregnated with 12% solid content polyurethane. The non-woven was coagulated with 30% dimethyl formamide (DMF), washed in 60° C. water and dried. The leather was further polished and was impregnated with an organic treatment agent containing silicon.

The leather was abraded by a machine to attain a substrate comprising the filament (31, 41) and polyurethane (32, 42). The substrate was bonded to a coating (44) with a paste (43) to make an artificial leather product having low resistance to deformation and high tensity. The artificial leather had a weight of 620 g/m$^2$, thickness of 1.31 mm, tensile strength of 32 kg/2.54 cm and peeling strength of 4.0 kg/cm.

Staple fibers in following examples 3, 5, 7 and 10 used the staple fibers from example 1 and staple fibers in following examples 4, 5, 8 and 9 used the staple fibers from example 2 to make into a non-woven a thickness by entangling and needle punching. Then, the non-woven was impregnated with polyurethane. The non-woven was coagulated with dimethyl formamide (DMF) and washed with water and dried. The conditions of the following examples 3-10 are shown in table 1.

TABLE 1

The experimental conditions were varied as follows:

| | Example | | | | | | | |
|---|---|---|---|---|---|---|---|---|
| Conditions | 3 | 4 | 5 | 6 | 7 | 8 | 9 | 10 |
| Nonwoven Weight (g/m2) | 370 | 374 | 211 | 228 | 227 | 208 | 200 | 360 |
| Nonwoven Thickness (mm) | 1.5 | 1.5 | 0.73 | 0.73 | 0.73 | 0.74 | 0.75 | 1.5 |
| Nonwoven impregnate | PVA 5% | — | PVA 10% | — | PVA 5% | — | — | PVA 10% |
| Solid % Polyurethane | 15% | 12% | 20% | 18% | 17% | 18% | 12% | 20% |
| % DMF | 30 | 30 | 30 | 30 | 30 | 30 | 30 | 30 |
| Water Temp (° C.) | 60 | 60 | 60 | 60 | 60 | 60 | 60 | 60 |

The leather above was abraded by a machine to attain a substrate comprising the filament (31, 41) and polyurethane (32, 42). The substrate had a coating (44) bonded thereon with a paste (43) to make an artificial leather product having low resistance to deformation and high elasticity. Properties of the artificial leather in each example of examples 3-10 are shown as table 2.

TABLE 2

The artificial leather produced varied as follows:

| | Example | | | | | | | |
|---|---|---|---|---|---|---|---|---|
| | 3 | 4 | 5 | 6 | 7 | 8 | 9 | 10 |
| Weight (g/m$^2$) | 640 | 622 | 560 | 540 | 560 | 540 | 530 | 640 |
| Thickness (mm) | 1.34 | 1.30 | 0.92 | 0.89 | 0.94 | 0.88 | 0.85 | 1.34 |
| Tensile Strength (kg/2.54 cm) | 38 | 33 | 39 | 35 | 36 | 32 | 34 | 35 |
| Peeling strength (kg/cm) | 4.3 | 4.1 | 3.5 | 3.1 | 3.4 | 3.1 | 3.3 | 4.3 |

Example 3

The staple fiber from example 1 was made into a non-woven being 370 g/m$^2$ and 1.5 mm thickness by entangling and needle punching, wherein the non-woven was impregnated with 5% polyvinyl alcohol (PVA) and dried. Then, the non-woven was impregnated with 15% solid content polyurethane. The non-woven was coagulated with 30% dimethyl formamide (DMF), washed in 60° C. water and dried. The leather was further polished.

Example 4

The staple fiber from example 2 was made into non-woven being 374 g/m$^2$ and having a thickness of 1.5 mm by entangling and needle punching. Wherein the non-woven was impregnated with 12% solid content polyurethane and dried. Then, the non-woven was impregnated with 12% solid content polyurethane. The non-woven was coagulated with 30% dimethyl formamide (DMF), washed in 60° C. water and dried. The leather was further polished.

Example 5

The staple fiber from example 1 was made into a non-woven being 211 g/m$^2$ and having a thickness of 0.73 mm by entangling and needle punching wherein the non-woven was impregnated with 10% polyvinyl alcohol (PVA) and dried. Then, the non-woven was impregnated with 20% solid content polyurethane. The non-woven was coagulated with 30% dimethyl formamide (DMF), washed in 60° C. water and dried. The leather was further polished and was impregnated with an organic treatment agent containing silicon.

Example 6

The staple fiber from example 2 was made into a non-woven being 228 g/m$^2$ and 0.73 mm thickness by water punching wherein the non-woven is impregnated with 18% solid content polyurethane and dries. Then, the non-woven was impregnated with 18% solid content polyurethane. The non-woven was coagulated with 30% dimethyl formamide (DMF), washed in 60° C. water and dried. The leather was further polished and was impregnated with an organic treatment agent containing silicon.

Example 7

The staple fiber getting from example 1 can be make to be the non-woven having 227 g/m$^2$ and 0.73 mm thickness by water punching wherein the non-woven is impregnated with 5% polyvinyl alcohol (PVA) and dry. Then, the non-woven was impregnated with 17% solid content polyurethane. The non-woven was coagulated with 30% dimethyl formamide (DMF), washed in 60° C. water and dried.

Example 8

The staple fiber getting from example 2 can be make to be the non-woven having 208 g/m$^2$ and 0.74 mm thickness by water punching wherein the non-woven is impregnated with 18% solid content polyurethane and dries. Then, the non-woven was impregnated with 18% solid content polyurethane. The non-woven was coagulated with 30% dimethyl formamide (DMF), washed in 60° C. water and dried. The leather was further polished.

Example 9

The staple fiber getting from example 2 can be make to be the non-woven having 200 g/m$^2$ and 0.75 mm thickness by water punching. The non-woven was impregnated with 12% solid content polyurethane. The non-woven was coagulated with 30% dimethyl formamide (DMF), washed in 60° C. water and dried. The leather was further polished.

Example 10

Splittable Type Staple Fiber Made be Non-Woven Having Soaking Property or Water-Base Polyurethane with Needle Punching The staple fiber getting from example 1 can be make to be the non-woven having 360 g/m$^2$ and 1.50 mm thickness by needle punching wherein the non-woven is impregnated with 10% polyvinyl alcohol (PVA) and dry. Then, the non-woven was impregnated with 20% solid content water-base polyurethane. The leather was further polished.

Example 11

Figure 6:
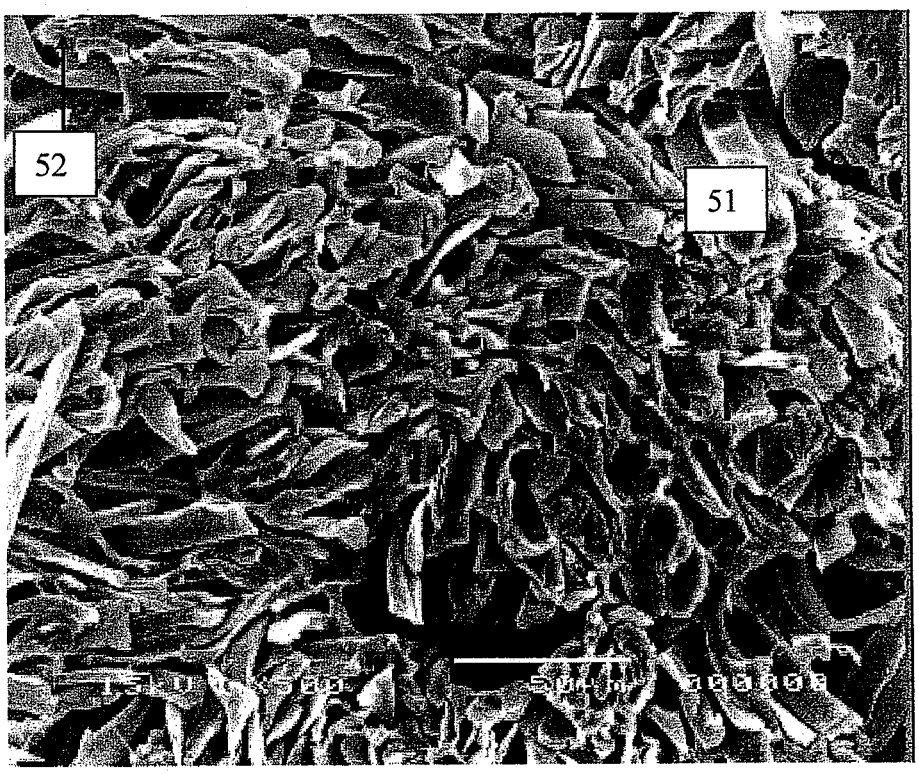
FIG. 6 is an electron microscopy image of another embodiment of a non-woven in accordance with the present invention.
Figure 7:
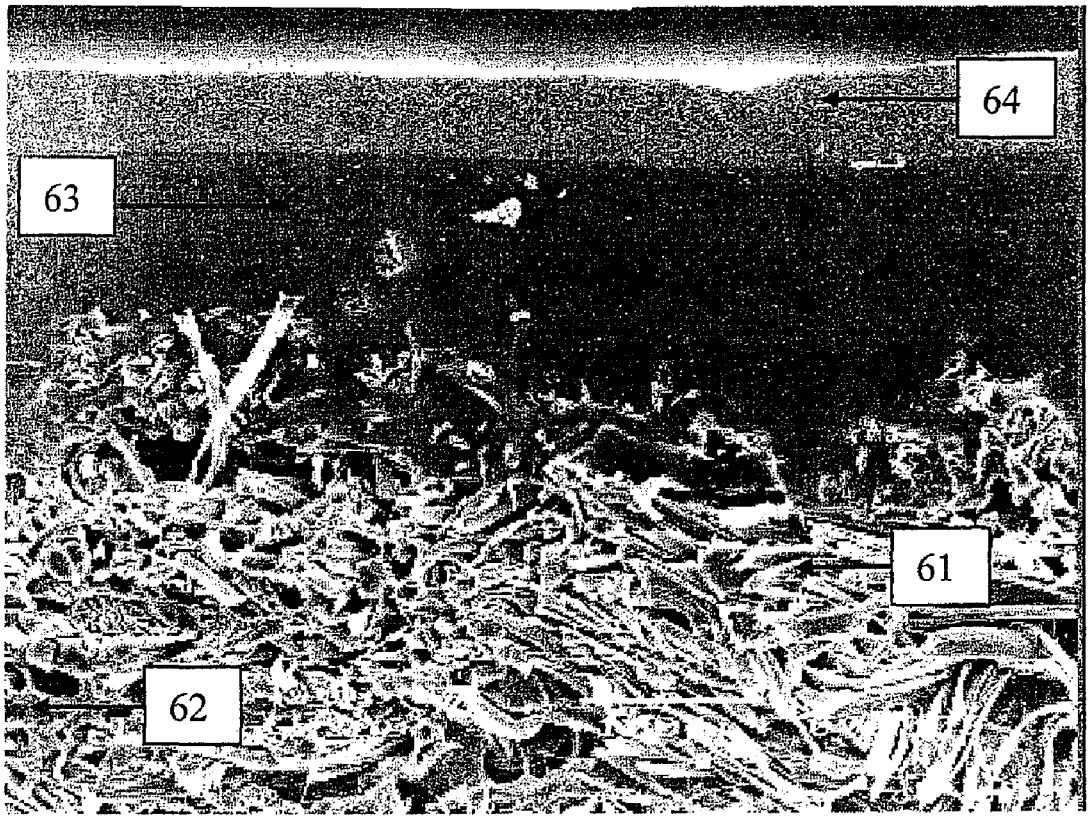
FIG. 7 is an electron microscopy image of another embodiment of artificial leather in accordance with the present invention.

Splittable Type Filament Made be Non-Woven Having or Solvent-Base Polyurethane with Spunbond PBT chip left to dry at 130° C. for 4 hours until poly (butylene terephthalate) contains less than 100 ppm. Nylon 6 (polymer B) chip to dry at 90° C. for 4 hours until Nylon 6 contained less than 300 ppm of water. Then, polymer A and polymer B were charged into the conjugate spinning machine having two extruders and a spinning beam. The temperature of the extruder of polymer A was set for 260° C., 276° C. and 276° C. form the first district to the third district. The temperature of the other extruder of polymer B was set for 265° C., 295° C. and 295° C. form the first district to the third district. The temperature of the spinning beam was set for 276° C. The conjugate spinning machine is preset to melt polymer A and polymer B in weight ratio was separately 42% and 58%. The filament has fineness being 2.6 den, strength being 5.53 g/den and elongation being 65% after draw unit of spunbond machine. The filament was made to be the non-woven having 200 g/cm$^2$ basis weight and 0.7 mm thickness by needle punching. The non-woven was impregnated with 11% solid content polyurethane. The non-woven was coagulated with 30% dimethyl formamide (DMF) and was washed in the 60° C. hot water and dry. With reference FIGS. 6 and 7, the leather was abraded by a machine to attain a substrate comprising the filament (51, 61) and polyurethane (52, 62). The substrate was bond to a coating (54, 64) with a paste (53, 63) to make an artificial leather product having low resistance to deformation and high tensity. The artificial leather has weigh of 550 g/m$^2$, thickness of 0.9 mm, tensile strength of 32 kg/2.54 cm and peeling strength of 3.4 kg/cm.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A method for producing microfine fibers artificial leather with low resistance to deformation and high tensity comprising acts of:

(a) providing polymer A and polymer B in a ratio between 32% to 68% and 68% to 32%;

(b) melting polymer A and polymer B to make a filament with an alternate arrangement having 24 to 128 number alternating units of the polymer A and the polymer B;

(c) drawing the filament to make a staple fiber;

(d) entangling the staple fiber to form a non-woven;

(e) impregnating the non-woven with an impregnating agent to manufacture a leather; and (g) the leather was further polished and kneaded;

wherein polymer A is polybutylene terephthalate (PBT) and polymer B is polyamide.

2. The method for producing artificial leather as claimed in 1 further comprising an act of (f) impregnating the non-woven with polyurethane after the non-woven with the impregnating agent in act of (e).

3. The method for producing artificial leather as claimed in 1, wherein Polyamide is selected from the group consisting of F Nylon 6 and Nylon 66.

4. The method for producing artificial leather as claimed in 1, wherein the act of entangling the staple fiber to form a non-woven is selected from the group consisting of the water punching, the needle punching and the spunbond.

5. The method for producing artificial leather has claimed in 1, wherein the impregnating agent is selected from the group consisting of silicon, polyurethane and polyvinyl alcohol;

the method further comprising an act of impregnating the non-woven with a treatment agent after the act of impregnating the non-woven with the impregnating agent; and the concentration of the treatment reagent is between 0.1 and 15%.

6. The method for producing artificial leather as claimed in 5, wherein the concentration of the treatment reagent is between 3 and 10%.

7. The method for producing artificial leather as claimed in 2, wherein the polyurethane is selected from the group consisting of water-base polyurethane and oil-polyurethane; wherein a solid content of solvent-base polyurethane is 10 to 25% and a solid content of water-base polyurethane is 15 to 30%.

8. The method for producing artificial leather as claimed in 7, wherein the solid content of solvent-base polyurethane is 14 to 20% and the solid content of water-base polyurethane is 18 to 26%.

* * * * *